United States Patent [19]

Vella

[11] 4,044,917

[45] Aug. 30, 1977

[54] CLOSURE ELEMENT FOR A CONTAINER

[76] Inventor: James Vella, 504 Walker St., SW., Vienna, Va. 22180

[21] Appl. No.: 701,205

[22] Filed: June 30, 1976

[51] Int. Cl.[2] ..... B65D 45/32

[52] U.S. Cl. ..... 220/288; 220/319; 215/329

[58] Field of Search ..... 220/288, 319; 215/329

[56] References Cited

U.S. PATENT DOCUMENTS

| | | | |
|---|---|---|---|
| 759,168 | 5/1904 | Fenn | 215/329 |
| 770,271 | 9/1904 | Doehrer | 220/288 |
| 798,507 | 8/1905 | Hally | 220/288 |
| 2,267,754 | 12/1941 | Schroeder | 220/288 |
| 3,595,427 | 7/1971 | Markowitz | 220/288 |
| 3,905,509 | 9/1975 | Markowitz | 220/319 |

*Primary Examiner*—Ro E. Hart

*Attorney, Agent, or Firm*—Birch, Stewart, Kolasch and Birch

[57] ABSTRACT

An expandable, externally-threaded collar member which is adapted to cooperate with an internally-threaded cap member to form a closure for a container. Advantageously, the expandable, externally-threaded collar member can be applied to the top, neck portion of the container by merely sliding said collar member over the rim of the container. Once in place, the container can then be sealed by applying the internally-threaded cap member to the externally-threaded collar member.

9 Claims, 2 Drawing Figures

CLOSURE ELEMENT FOR A CONTAINER

BACKGROUND AND SUMMARY OF THE INVENTION

The present invention relates to an expandable, externally-threaded collar member which is adapted to cooperate with an internally-threaded cap member to form a closure for a container. More particularly, the present invention is directed to a closure unit wherein both the threaded collar member and the threaded cap member which cooperate together to form the closure unit are separable from the container which is to be closed.

A number of types of closures utilized for sealing the contents of a container are well known in the art. However, most of the presently utilized closures do not provide an effective seal and, accordingly, the substances stored within the container readily spoil or become contaminated because of the loss of the sealing capability of the container.

One of the most effective means for sealing a particular container is through the use of a screw-threaded closure. However, since many containers are not provided with a suitable threaded portion which can be used for engaging a threaded cap, such containers, such as for example, can containers, cannot be sealed by utilizing a screw-thread type of sealing means.

Accordingly, an object of the present invention is to provide a screw-type closure unit for a container which is not provided with a threaded portion which is integral with the container itself.

Another object of the present invention is to provide an expandable, externally-threaded collar member which is applied to the top portion of a container and an internally-threaded cap member which is adapted to cooperate with the collar member to form a closure for a container.

A further object of the present invention is to provide an expandable, externally-threaded collar member which is so constructed that it can be readily slipped over the top lip of the container and positioned around the neck of said container beneath said lip for receiving the internally-threaded cap member.

Other objects and further scope of applicability of the present invention will become apparent from the detailed description given hereinafter, it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the above disadvantages may be eliminated and a closure unit has been developed wherein a container can be provided with a screw-type seal even though the container does not possess a screw-threaded portion which is integral with the top portion of the container itself. According to the present invention, a container, for example a can, can be provided with a screw-type closure by mounting a threaded collar to the can, said collar cooperating with a threaded cap to form said closure unit. The threaded collar member is made of an expandable material, for example, a plastic material, and contains at least one slot which extends for a distance from one opened end of the collar, the expandable nature of the threaded collar and the presence of said slot enabling said collar to be mounted over a top lip of the container and positioned around the neck of said container beneath said lip. Advantageously, a plurality of slots are positioned equidistantly along the threaded collar, said slots increasing the overall flexibility of said collar, thereby enabling the collar to be stretched over the lip of the container and positioned around the neck of said container.

BRIEF DESCRIPTION OF THE DRAWINGS

The present invention will become more fully understood from the detailed description given hereinbelow the accompanying drawing which is given by way of illustration only, and thus is not limitative of the present invention and wherein.

DESCRIPTION OF THE PREFERRED EMBODIMENTS

Figure 1:
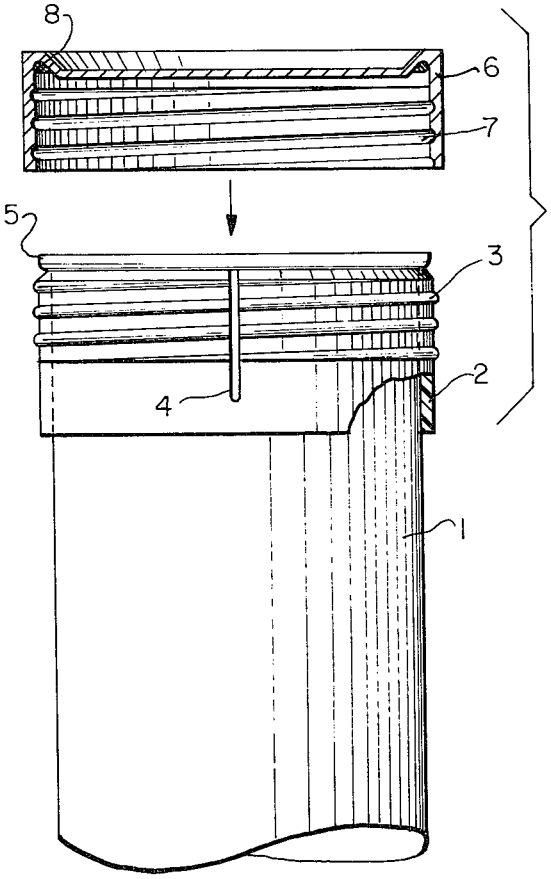
FIG. 1 shows a threaded collar member which has already been applied to the neck of a container and is adapted to receive a cap member.

The present invention will now be more specifically described with reference to the attached drawing and specific reference to FIGS. 1 and 2 in which a container, for example, a can or bottle 1 is provided with an externally-threaded collar member 2. The external thread 3 on the collar member extends a predetermined distance from the top of the collar member although it is readily apparent that any number of external threads can be provided on the collar member, and, in some instances, the entire width of the collar member can be provided with said threads. The externally-threaded collar member 2 is provided with at least one slot 4, and advantageously, a plurality of slots which are disposed along the periphery or circumferece of the collar member. In a preferred embodiment of the present invention, four slots are disposed equidistantly from each other around the collar member. Because of this particular feature of the present invention, it is possible to slip the collar member 2 over an enlarged top lip portion 5 to a position around the neck of the container beneath said lip. Because the threaded collar member is made of an elastic-type material, that is, a plastic material such as polyvinyl chloride, polyethylene, polyurethane, natural and synthetic rubbers, and the like, the threaded collar member inherently has elastic properties which facilitate the mounting of said collar member over the top lip of the container.

FIG. 1 also shows a cap member 6 which is provided with internal threads 7. The internally-threaded cap member thus cooperates with the externally-threaded collar member to form a closure for the container. The cap member is provided with a rubberized sealant 8 in its top portion which facilitates the sealing of the container when the cap member is engaged with the collar member.

Figure 2:
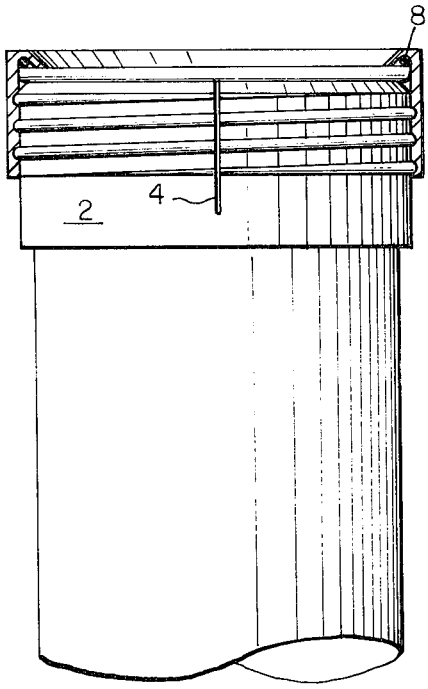
FIG. 2 shows the cap member in engaging relationship with the threaded collar member on the top of the container.

FIG. 2 shows the closure unit of the present invention wherein the externally-threaded collar member is completely engaged with the internally-threaded cap member. Since the internal diameter of the collar member must correspond to the external diameter of the neck portion of the container in order to maintain and hold said collar member in position around the neck of said container, it is necessary for the collar member to be stretched in an amount sufficient to be mounted over the lip 5 of the can, but at the same time it is also necessary that said collar member return to its original size after it is applied to the neck of the container so that there will be no problem in providing an engaging relationship between said collar member and the cap member.

It should also be readily apparent that the slots can extend from either of the open ends thereof, that is, the slots can extend through the threaded portion of the collar member as shown in FIG. 1 or can extend in the opposite direction from the base of the collar toward said threads. As stated hereinabove, the main purpose of the slots is to enable said collar member to be stretched over an enlarged lip portion of the container when said collar member is mounted to the container. However, in another feature of the present invention the base of the collar member, that is, that portion of the collar member 2 below the threaded portion 3 has an inside diameter larger than the outside diameter of the bottle or container 1. In this instance the inside diameter of the collar member adjacent the threaded portion 3 has an inside diameter substantially equal to the outside diameter of the container. Thus, in mounting the collar member on the container, the larger diameter of the base portion of the collar member facilitates the mounting of this portion over the lip 5 of the container and the slots 4 facilitate mounting the remaining portion of the collar member. An inclined portion is disposed between the two different inside diameters of the collar member thereby providing a smooth transition therebetween.

Where reference is made in the specification to internal and external threads, internal is intended to mean inside of the lid and external is intended to mean on the outside of the collar member. It is readily apparent that the lid and the collar member can be provided with either male or female threads.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A stretchable, externally-threaded collar member which is adapted to cooperate with an internally-threaded cap member to form a closure for a container, said threaded collar member containing at least one slot which extends for a distance from one open end thereof, the stretchable nature of said threaded collar and the presence of said slot enabling said threaded collar to be mounted over a top lip of the container and positioned around the neck of said container beneath said lip.

2. The stretchable threaded collar of claim 1, wherein a plurality of slots are positioned equidistantly along said threaded collar.

3. The stretchable threaded collar of claim 1, wherein said collar is made of an elastic material which is capable of being stretched to a larger size for mounting over the top lip of the container and returns to its original size in conformity with the neck of the container for engaging relationship with said cap member.

4. The stretchable threaded collar of claim 3, wherein said collar is made of a plastic material.

5. The stretchable threaded collar of claim 2, wherein the threads of the externally-threaded collar member extend for a distance from the top of the collar and the slots extend through said thread to a point beyond that where the threads are discontinued.

6. The stretchable threaded collar of claim 2, wherein the threads of the externally-threaded collar member extend for a distance from the top of the collar and the slots extend from the bottom of the collar up to the proximity of the thread.

7. A closure unit adapted to be applied to the top of a container comprising a stretchable, externally-threaded collar member and an internally-threaded cap member, said threaded collar member containing at least one slot which extends for a distance from one open end thereof, the stretchable nature of said threaded collar member and the presence of said slot enabling said threaded collar to be mounted over a top lip of the container, said externally-threaded collar member cooperating with said internally-threaded cap member to form said closure unit.

8. The closure unit of claim 7, wherein a plurality of slots are positioned equidistantly along said threaded collar.

9. The stretchable, externally threaded collar member of claim 1 wherein said collar member is provided with a non-threaded base portion which has an inside diameter larger than the outside diameter of the container, thereby facilitating the mounting of the collar member over the lip of the container.

* * * * *